US008456374B1

(12) United States Patent
Bagley et al.

(10) Patent No.: US 8,456,374 B1
(45) Date of Patent: Jun. 4, 2013

(54) ANTENNAS, ANTENNA SYSTEMS AND METHODS PROVIDING RANDOMLY-ORIENTED DIPOLE ANTENNA ELEMENTS

(75) Inventors: Zachary C. Bagley, Salt Lake City, UT (US); Marc J. Russon, Salt Lake City, UT (US); David G. Landon, Bountiful, UT (US)

(73) Assignee: L-3 Communications, Corp., Salt Lake City, UT (US)

( * ) Notice: Subject to any disclaimer, the term of this patent is extended or adjusted under 35 U.S.C. 154(b) by 472 days.

(21) Appl. No.: 12/589,770

(22) Filed: Oct. 28, 2009

(51) Int. Cl.
*H01Q 21/10* (2006.01)
*H01Q 9/28* (2006.01)

(52) U.S. Cl.
USPC ..... 343/810; 343/795; 343/895

(58) Field of Classification Search
None
See application file for complete search history.

(56) References Cited

U.S. PATENT DOCUMENTS

| | | | | |
|---|---|---|---|---|
| 5,038,149 | A | 8/1991 | Aubry et al. | 342/372 |
| 5,581,257 | A * | 12/1996 | Greene et al. | 342/51 |
| 6,127,977 | A | 10/2000 | Cohen | 343/700 MS |
| 6,140,975 | A | 10/2000 | Cohen | 343/846 |
| 6,300,914 | B1 | 10/2001 | Yang | 343/741 |
| 6,426,723 | B1 | 7/2002 | Smith et al. | 343/700 MS |
| 6,452,553 | B1 | 9/2002 | Cohen | 343/702 |
| 6,471,878 | B1 * | 10/2002 | Greene et al. | 216/13 |
| 6,476,766 | B1 | 11/2002 | Cohen | 343/700 MS |
| 6,590,531 | B2 | 7/2003 | McKinzie, III et al. | 342/375 |
| 6,870,515 | B2 | 3/2005 | Kitchener et al. | 343/853 |
| 6,975,277 | B2 | 12/2005 | Tran | 343/792.5 |
| 7,019,695 | B2 | 3/2006 | Cohen | 343/700 MS |
| 7,113,141 | B2 | 9/2006 | Almog et al. | 343/795 |
| 7,450,056 | B2 * | 11/2008 | Shirakawa et al. | 342/159 |
| 2003/0151556 | A1 | 8/2003 | Cohen | 343/700 MS |
| 2004/0227682 | A1 * | 11/2004 | Anderson | 343/742 |
| 2007/0188398 | A1 * | 8/2007 | Mohuchy et al. | 343/795 |
| 2007/0240757 | A1 * | 10/2007 | Ren et al. | 136/256 |
| 2007/0241984 | A1 * | 10/2007 | Schadler | 343/820 |
| 2008/0306360 | A1 * | 12/2008 | Robertson et al. | 600/302 |
| 2010/0001894 | A1 * | 1/2010 | Holly et al. | 342/1 |

OTHER PUBLICATIONS

"Fractal antenna", Wikipedia, http://en.wikipedia.org/wiki/Fractal_antenna, Sep. 29, 2006, 1 pg.

* cited by examiner

*Primary Examiner* — Trinh Dinh
(74) *Attorney, Agent, or Firm* — Kirton McConkie

(57) ABSTRACT

In one exemplary embodiment, an antenna arrangement includes: a substrate; and a plurality of dipole antenna elements disposed on the substrate, wherein the plurality of dipole antenna elements are randomly-oriented with respect to each other. In further exemplary embodiments, the plurality of dipole antenna elements includes at least six dipoles that are all electrically fed and do not need to be magnetically fed in order to generate and detect an arbitrary polarization. In still further exemplary embodiments, each dipole element has a fractal shape.

23 Claims, 3 Drawing Sheets

ANTENNAS, ANTENNA SYSTEMS AND METHODS PROVIDING RANDOMLY-ORIENTED DIPOLE ANTENNA ELEMENTS

TECHNICAL FIELD

These teachings relate generally to a multiple input multiple output (MIMO) system and, more specifically, relate to antenna design for a MIMO system.

BACKGROUND

Multiple input multiple output (MIMO) systems utilize multiple transmit and receive antennas to offer various improvements over traditional single input single output (SISO) wireless communication systems, such as increases in throughput and range at the same bandwidth and same overall transmit power expenditure. In general, MIMO technology can increase the spectral efficiency of a wireless communication system. Wireless MIMO communication exploits phenomena such as multipath propagation to potentially increase data throughput and range, or reduce error rates, rather than attempting to eliminate the effects of multipath propagation, as traditional SISO communication systems often seek to do.

A fractal is a geometric shape that can be subdivided in parts, each of which is (at least approximately) similar to the whole. Fractals generally have three properties: (a) self-similarity; (b) a fractal or Hausdorff dimension (usually greater than the shape's topological dimension); and (c) production by an iterative process. A "true" fractal features self-similarity at all resolutions and is generated by infinite iterations. In reality, fractal shapes are generated by a finite process iterated a finite number of times. However, such finite fractal-like shapes may comprise sufficient approximations such that they may be referred to, and considered, as fractals. Some of the more well-known fractals include the Koch snowflake, Sierpinski triangle, Cantor set, Julia set and Mandelbrot set.

U.S. Pat. No. 6,140,975 to Cohen shows various fractal antenna structures. For example, FIG. 7D-5 shows an antenna system having fractal ground elements and a fractal vertical element. Note that these antenna elements must be placed orthogonally and are then tuned by varying the separation distance or by forming a "cut" in an element. FIG. 8B shows an arrangement of fractal antennas which form a sectorized antenna array. A circuit selects the element having the best orientation toward the base station (e.g., by determining the strongest signal). Thus, only one of the antenna elements is active at any given time. The antenna elements are preferably fed for vertical polarization. Furthermore, the antenna system must be tuned for each particular conformal shape. U.S. Pat. No. 6,452,553 to Cohen describes additional fractal antenna structures.

SUMMARY

In one exemplary embodiment of the invention, an antenna arrangement comprising: a substrate; and a plurality of dipole antenna elements disposed on the substrate, wherein the plurality of dipole antenna elements are randomly-oriented with respect to each other.

In another exemplary embodiment, a communication system comprising: at least one antenna arrangement comprising a substrate and a plurality of dipole antenna elements disposed on the substrate, wherein the plurality of dipole antenna elements are randomly-oriented with respect to each other; at least one processor coupled to the at least one antenna arrangement, wherein the at least one processor is configured to perform at least one of generating a first signal to be transmitted via the at least one antenna arrangement and processing at least one second signal received via the at least one antenna arrangement.

BRIEF DESCRIPTION OF THE DRAWINGS

The foregoing and other aspects of embodiments of this invention are made more evident in the following Detailed Description, when read in conjunction with the attached Drawing Figures, wherein.

DETAILED DESCRIPTION

Exemplary embodiments of the invention eliminate the need to place antenna elements in specific locations, thereby eliminating the requirement to tune the antenna system for any particular polarization or desired radiation pattern. Below it is shown that placing a plurality of dipoles (e.g., electric dipoles, fractal dipoles) in a volume and then digitally processing the signals from these elements using the knowledge that the signals are generated from randomly-oriented dipoles has the same throughput potential as antennas (e.g., fractal antennas) that have "tuned" shapes. It is further shown below that six center-fed electric dipoles contained in a volume with a radius of at least half wavelength can generate and detect any state of polarization. If electric and magnetic feeds are provided, then only three dipoles are needed (since there are six possible polarization states at any given point in space: (x, y, z) for electric and magnetic fields).

In contrast to conventional antenna systems (e.g., fractal antenna systems), simultaneously processing a plurality of randomly-oriented dipoles (e.g., fractal dipoles), as further described below, provides for greater coverage and does not require physically tuning the antenna for a particular fabrication method or shape. The radiation pattern for a given set of randomly-oriented antenna elements can be "tuned" (or equalized) by the digital signal processing instead of during the fabrication process.

Figure 1:
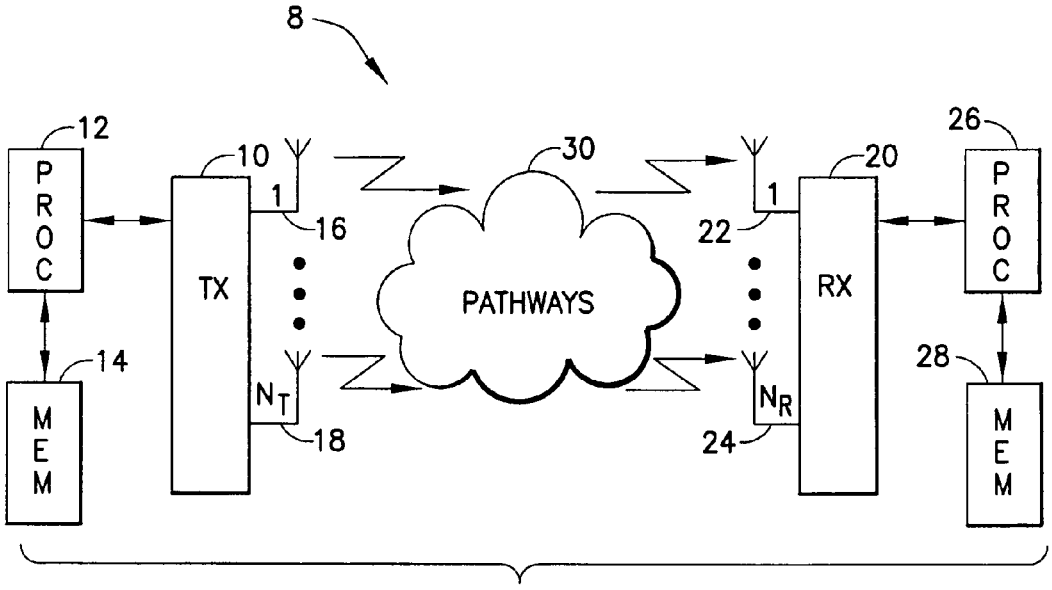
FIG. 1 depicts an exemplary MIMO wireless communication system with which exemplary embodiments of the invention may be utilized.

FIG. 1 depicts an exemplary MIMO wireless communication system 8 with which exemplary embodiments of the invention may be utilized. The system 8 includes a transmitter (TX) 10 and a receiver (RX) 20. The TX 10 is coupled to a plurality of transmit antennas 16, 18 numbering from 1 to $N_T$. The RX 20 is coupled to a plurality of receive antennas 22, 24 numbering from 1 to $N_R$. The antennas 16, 18, 22, 24 are employed in a multi-path environment (pathways) 30 such that signals sent from the TX 10 to the RX 20 experience multipath propagation. The scattered signals between the TX 10 and the RX 20 are represented in FIG. 1 as the pathways 30.

In addition, the TX 10 is coupled to a processor (PROC) 12 which is in turn coupled to a memory (MEM) 14. Similarly, the RX 20 is coupled to a processor (PROC) 26 which is in turn coupled to a memory (MEM) 28. The PROCs 12, 26, in conjunction with the MEMs 14, 28, may be utilized in conjunction with the TX 10 or RX 20 in order to enable transmission or reception of the MIMO signal, respectively. The PROCs 12, 26 enable pre and post-processing of the MIMO signal while the MEMs 14, 28 may store various information or data, such as the unprocessed signal and/or other communications-related information. Various coding methods and signal processing techniques, such as ones known in the art, may be utilized to advantage with the MIMO communication system 8.

Exemplary embodiments of the invention may also be used to advantage in other wireless communication systems, such as a system utilizing one antenna, for example. As a further non-limiting example, exemplary embodiments of the invention may be practiced in a system having a plurality of antennas but not utilizing MIMO communication techniques. Exemplary embodiments of the invention may also be utilized in conjunction with Beamforming techniques.

It should be understood that references herein to random aspects (e.g., random orientations or randomly-oriented elements) do not exclude corresponding pseudo-random aspects (e.g., pseudo-random alignment or orientations). For example, orientations of antenna elements generated in a pseudo-random fashion using a seed (also referred to as a random seed or seed state) may be used.

As utilized herein, a dipole antenna is considered to be a straight electrical conductor connected at the center to a radio-frequency (RF) feed line. A dipole antenna generally measures ½ wavelength from end to end. This antenna, also called a doublet, constitutes the main RF radiating and receiving element in various sophisticated types of antennas. The dipole is inherently a balanced antenna because it is bilaterally symmetrical. Dipole antennas generally have an orientation. The polarization of the electromagnetic (EM) field radiated by a dipole transmitting antenna corresponds to the orientation of the dipole antenna. When the antenna is used to receive RF signals, it is most sensitive to EM fields having a polarization parallel to the orientation of the antenna.

As utilized herein, an antenna arrangement is considered to comprise at least one antenna element. The at least one antenna element may comprise a plurality of dipole antennas, for example.

I. INTRODUCTION

Wireless communication systems with multiple electromagnetic feeds comprise MIMO communication systems. The size and shape of antenna configurations for MIMO signals are typically defined by such considerations as the transmission frequency, the desired information throughput, and polarization requirements, as non-limiting examples. Antennas that enable the transmitter and receiver to use spatially separated feeds, and that reduce dependency on transmission frequencies and polarizations, are therefore generally desirable. At least some exemplary embodiments of the invention provide the ability to form (e.g., simultaneously) controllable beam patterns in multiple frequency bands in order to reduce these dependencies.

To show how arbitrary polarizations are detected, an electro-magnetic model of an antenna in a sphere is discussed below, leading to an exemplary arbitrary volumetric antenna based on dipole antennas that can transmit and detect multiple polarizations. Simplified analyses are made possible by assuming regular geometric shapes such as a tripole (3 electric, 3 magnetic feeds), a tetrahedron (6 electric feeds) or a cube (12 electric feeds), as non-limiting examples. Randomly oriented dipoles in a volume are shown to have the same averaged capacity, and the resulting volumetric antenna can still detect arbitrarily polarized signals. Therefore, the tetrahedron and cube configurations may be considered special cases of arbitrary antennas inside a volume. However, due to various factors, such as fabrication difficulties as a non-limiting example, it may be desirable to utilize a configuration of randomly oriented planar antennas in a volume since they are shown to have the same averaged channel capacity.

Multi-band operation is possible by noting two criteria to satisfy in order for one antenna shape to work equally well at multiple (e.g., all) frequencies: (i) there should be symmetry about a point and (ii) the antenna shape should have the same basic appearance at multiple (e.g., every) scale. Fractal shapes have these properties as they are generally self-similar (portions resemble the whole) and independent of scale (the shape appears similar at multiple levels of magnification). Fractal based 2-D antennas are known to be wide-band and are shown to perform essentially as a dipole antenna. Multiple frequencies and polarizations can therefore be processed simultaneously by using 2-D fractal shapes as the dipole antennas in a 3-D volumetric antenna. Any shape that has an electric dipole antenna response suffices as component antennas inside a volume, however using fractal dipoles is shown to reduce the size of the required volume and provide multi-band operation.

Composite 3-D fractal antennas provide the capability for multi-mode beam-forming since spatial and polarization diversities are simultaneously available in multiple frequency bands. In one exemplary embodiment of the invention, a planar fractal shape is used for one or more of the components in a volumetric antenna configuration to provide these properties in a compact form factor.

Below, an electro-magnetic model based on spherical vector waves is presented. This model can be used to show an arbitrary antenna contained in a sphere of radius R can illuminate spatial channels.

There are an infinite number of spatial channels, corresponding to the spherical vector modes. An ideal antenna connects each feed port to a spherical vector mode. The classical theory of radiation-Q uses spherical vector modes to quantify the number of these spatial channels that are actually available, given a realistic model of the antenna. An antenna with a high Q-factor has electromagnetic fields with large amounts of stored energy around it, and, hence, typically low bandwidth and high losses. The mode expansion provides a method to capture effects of the polarization, angle, and spatial diversity on the capacity of a MIMO system. One exemplary approach outlined herein is to link the Q-factor of a resonant circuit model to the received power per dimension.

One exemplary objective is to statistically model antenna and channel interfaces in such a way that the capacity of an arbitrary MIMO antenna inside a volume, such as for a sphere of radius e, can be expressed. This is accomplished by showing a number of impinging wavefronts can be represented with a time-varying linear matrix model. Statistical properties of the wavefront model are developed and used to motivate a system architecture.

The classical theory of radiation-Q uses spherical vector modes to analyze the properties of a hypothetical antenna inside a sphere. An antenna with a high Q-factor has electromagnetic fields with large amounts of stored energy around it, causing low bandwidths and high losses. The mode expansion provides a method to capture effects of the polarization, angle, and spatial diversity on the capacity of MIMO systems. The exemplary approach of this section is to develop a relationship between the Q-factor of a resonant circuit model and the received power per dimension. This model may be extended to include correlation, providing a statistical channel model with properties shown to closely match those of measured real-time indoor and outdoor MIMO channels. Statistical properties of this model are described in terms of the eigenvalue probability distribution functions (PDFs). General effects of correlation on capacity are discussed and used to model the measured effects of correlation sources, such as a strong direct component shown to be present in sub-urban environments and even in many indoor channels, as a non-limiting example. Eigenvalue distribution functions for the approximated and measured wireless electro-magnetic channels are shown to closely follow distribution functions for the Rayleigh and Ricean statistical channel models. This fact is used to form a composite channel model comprising weighted Rayleigh and Ricean distributions where the weighting defines the amount of correlation in the channel. This model provides a way to analytically and numerically estimate performance under correlated channel conditions.

II. MIMO SYSTEM MODEL

Let $d=[d_1, \ldots, d_K]^T$ be a vector of data symbols and $S=[s_1\ s_2 \ldots s_K]$ be a matrix of K sequences of length $N_t$, such that $x=Sd$. A complex channel response matrix H with $N_t$ columns and $N_r$ rows results in the well-known linear MIMO channel model:

$$y=HSd+n=Hx+n \tag{1}$$

where H has dimensions $N_r \times N_t$, x is the $N_t \times 1$ vector of transmitted data symbols, and n is a $N_r \times 1$ vector of additive white Gaussian noise (AWGN) samples. Instantaneous transmitted energy is characterized by the matrix $W=SS^*$, with total transmitted power limited by the constraint $E[tr(W)]=P_t$.

A. Random Matrix Channel Model

The objective of this section is to develop a random matrix linear algebraic model for the MIMO channel based on statistical properties of electro-magnetic fields and wave propagation. Such a model allows the use of well-known capacity formulas in order to estimate the capacity of a number of randomly oriented antennas in a sphere. End-to-end signal processing and antenna performance is linked to the basic quality measurements of spectral efficiency as a function of $E_b/N_0$.

The channel response matrix H represents the transfer function from x to y, through transmit and receive transmission lines, matching networks, and antenna feed interfaces, as well as the wave propagation channel responses. In order to separate the antenna properties from the properties of the wave propagation, the channel is decomposed into a combination of a transmitting antenna channel, $H_t$, a wave propagation channel $H_p$, and a receiving antenna channel $H_r$. The result is an overall channel response given by $H=H_rH_pH_t$.

The propagation distance is assumed to be large enough so that there is little or no mutual coupling between the transmitting and receiving antenna arrays. Mutual coupling within the array is an inherent component of the wavefront model, and manifests as correlation in the channel that determines the PDF for the eigenvalues of the channel correlation matrix $R=E[HH^*]$. The electro-magnetic wave models are described first, followed by the antenna responses, and finally a propagation model. These models are used to formulate a random matrix model that allows well-known MIMO channel capacity expressions to be applied. These capacity formulas are then used in following sections to compare performance.

The rows of a matrix $R_t$ correspond to how the modes of the spherical vector wave in the direction of $\hat{k}_n$ are coupled to the $N_t$ transmit antennas. On the receiving side, the columns of a matrix $R_r$ correspond to how the spherical vector modes in the direction of $\hat{k}_n$ are coupled to the $N_r$ receive antennas. The mappings are linear and so a linear mapping from the receiver expansion coefficients $\alpha_{r,\theta}$ to the received signal y is assumed such that the received signal vector can be expressed in terms of the square-roots of the transmit and receive correlation matrices:

$$y=R_r^{1/2}RR_t^{1/2}Sd+n \tag{2}$$

Properties of (2) specify suitable signal processing and coding for MIMO channels. Some considerations include:

- $R_t$ and $R_r$ characterize the transmitter and receiver arrays, respectively;
- R is a random matrix with statistical parameters determined by the channel;
- S maps K information sequences to $N_t$ antennas; and
- When the channel is known at the transmitter, S can be used as a pre-processing matrix (e.g., for water-filling or Beamforming).

III. MIMO VOLUMETRIC ANTENNAS

Three exemplary MIMO antennas that can be modeled using (2) are considered in order to illustrate the mode coupling concept. The tripole, tetrahedron, and cube antennas are considered below. These antenna arrangements are illustrative and non-limiting.

The tripole antenna utilizes three electric and three magnetic feeds to produce six potentially orthogonal channels. It is known that geometric shapes such as a cube or tetrahedron with electric dipoles on each edge can be used to avoid the problem of feeding both magnetic and electric dipoles. In this case, small edge lengths are shown to limit the response to the first three electric modes. Larger edge lengths increase the magnetic dipole contribution, while edge lengths that correspond to half-wavelength separation create the conventional beam-forming array with equal power in electric and magnetic fields in all directions.

Aligning the dipoles in regular shapes allows many simplifications in the electric and magnetic field simulations and analysis. These simplifications are due to symmetries afforded by right-angle and parallel orientations of the dipoles.

Such shapes have practical problems in terms of fabrication and predicted versus actual performance. These complications include mutual coupling, matching of the dipoles, and fabricating the assembly (e.g., the cube assembly). Measured and analytical data (see the last part of this section) indicate randomly oriented dipoles in a volume have the same capacity as regular geometric shapes.

A. Radiation-Q Characterization

An assumption of idealized antennas makes $R_t=R_r=I$ in (2). Clearly, this is not physically possible in the context of spherical vector waves since the model would then imply a spatial channel can be created for each wave incident on a sphere regardless of contained volume. Realistic antenna performance is determined by expressing the singular values for the square-roots of the correlation matrices in terms of the radiation efficiency, or Q-factor, which causes higher order modes to have reduced amplitudes and limits the response to a finite number of modes (spatial channels) within a sphere of radius $\in$.

Classical methods can be used to model the antenna and transmission lines as a lumped circuit. The spherical vector wave modes have a resonant circuit representation of the complex impedance Z of the modes. These equivalent circuits contain resistance (R), capacitance (C), and inductance (L) elements used to model the radiated field, the stored electric field, and the stored magnetic field, respectively, and can be used to model the antenna transfer function. The higher order modes are given by a ladder network, which can be interpreted as high-pass filters. It is possible to use the Fano theory to obtain fundamental limitations on the matching network equivalent circuit for each magnetic and electric spatial mode, however the process is complex.

Instead of using the resulting complicated expressions of the impedance for the equivalent circuit of each mode, it is common to use the antenna efficiency, or Q-factor, to estimate the achievable bandwidth. There is extensive literature on the Q-factor for antennas. The Q of the antenna is defined as the quotient between the power stored in the reactive field and the radiated power:

$$Q = 2\omega\frac{\max(W_M, W_E)}{P} \tag{3}$$

where $\omega$ is the angular frequency, $W_M$ is the stored magnetic energy, $W_E$ is the stored electric energy, and is the dissipated power. It is assumed P is the average power, i.e., the total dissipated power for the array of $N_t$ antennas is $P_t=PN_t$.

At the resonant frequency, $W_E=W_M$, which minimizes the Q-factor. Equal amounts of stored electric energy and stored magnetic energy are present. As a result, the antenna can be modeled as a single-pole, single-zero resonant RLC circuit with a corresponding Q-factor.

Figure 2:
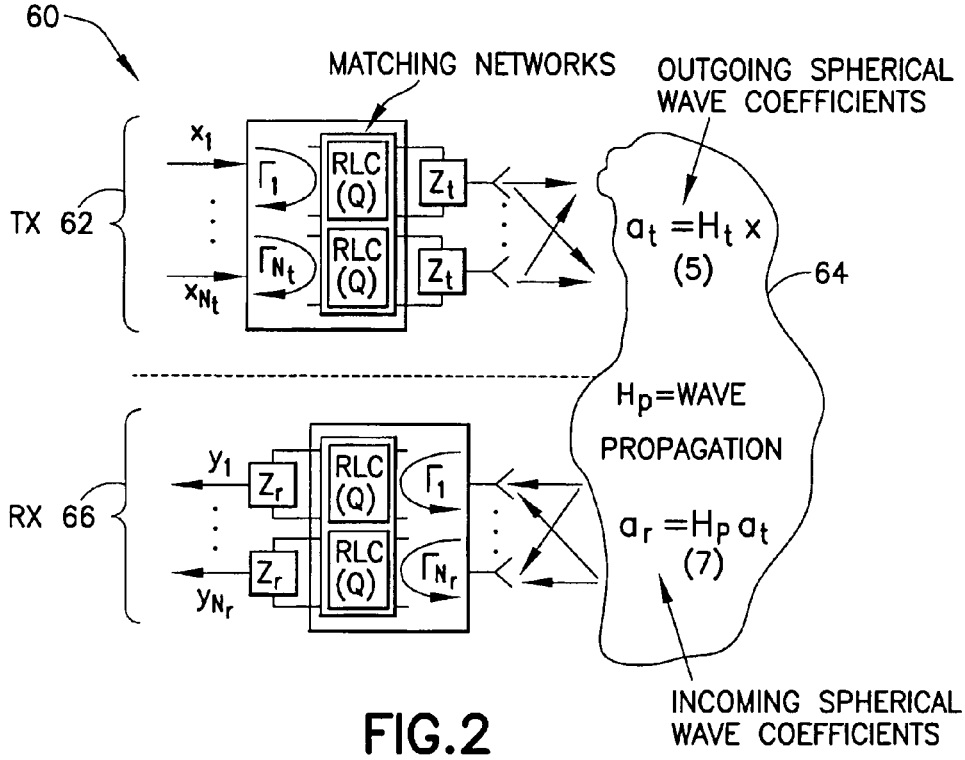
FIG. 2 is a diagram illustrating an exemplary MIMO antenna and wave propagation model.

FIG. 2 is a diagram illustrating an exemplary MIMO antenna and wave propagation model 60. A MIMO transmitter (TX) 62 transmits a signal in accordance with the outgoing spherical wave coefficients ($a_t$). The transmitted signal propagates through an environment 64 and is received by a MIMO receiver (RX) 66 as a signal in accordance with the incoming spherical wave coefficients ($a_r$).

As mentioned previously, it is very difficult to use the equivalent circuit approach for higher modes. Analytical expressions are only slightly less complicated, however they allow the Q-factor for all the magnetic ($PM_{lm}$) and electric ($PE_{lm}$) modes to be computed.

The impedance of the antenna is matched to the feeding network at and around the resonant frequency, $\omega_0=2\pi f_0$. For frequencies around the resonant frequency the radiated power is $P_t=|T(s)|^2P_{in}=(1-|\Gamma(s)|^2)P_{in}$ where T(s) and $\Gamma(s)$ are the transmission and reflection coefficients, respectively.

Transmission lines are assumed to have unit impedance, so that the transmission coefficient of an equivalent single-pole, single-zero RLC circuit.

The Fano theory is applied to these expressions for the poles and zeros to reach the following performance bounds on the reflection coefficient, $$|\Gamma| \geq e^{-\frac{\pi}{QB}\left(1-\frac{B^2}{4}\right)} \tag{4}$$

and the bandwidth, $$QB \leq \frac{\pi}{\log|\Gamma|^{-1}} \tag{5}$$

An upper bound on the fractional bandwidth B can be determined from the Q-factor and (5) by noting that a typical standing wave ratio (SWR) value of 2 corresponds to:

$$|\Gamma| \equiv \frac{SWR-1}{SWR+1} = \frac{1}{3} \tag{6}$$

Reflection coefficients computed from the Q-factors for the first few values of l show spatial channels become highly correlated with small volumes and the antenna array can only excite one mode (spatial channel) no matter how many dipoles are in the volume. In this case the extra antennas can provide SNR gain at the receiver, but they cannot provide additional sub-channels to increase throughput.

IV. MIMO CHANNEL CAPACITY

The ergodic channel capacity for random MIMO channels is considered. Random matrix theory is used to arrive at the capacity formulas. These formulas are applied to the random channel discussed in the previous sections.

A. Ergodic Channel Capacity

Given the model of (1), it is well known that the instantaneous channel capacity for a given power matrix W and channel matrix H is $\log_2$ $$\det\left(I + \frac{1}{N_0}H^*WH\right)$$

bits per MIMO symbol x. Therefore, the objective is to determine the W subject to the constraint W=SS* such that $C_l$ (H,W) is maximized, i.e., $$C_l(H, W) = \max_w \log\det\left(I + \frac{1}{N_0}H*WH\right) \tag{7}$$

$$\leq \log\det\left(I + \frac{P_t}{N_tN_0}H^*H\right) \tag{8}$$

where the last inequality is a result of the concavity of log det and full-rank Gaussian H such that $W_{opt}=I/N_t$. Ergodic channel capacity (7) is averaged over realizations of H (e.g., all possible realizations). Noting the determinant is a product of the eigenvalues, the ergodic capacity can be written as:

$$C = E_H[C_I] = \sum_{i=1}^{rank(H^*WH)} E_{\lambda_i} \max_{w_i} \log\left(1 + \frac{w_i\lambda_i}{N_0}\right) \tag{9}$$

where $\{w_i\lambda_i\}$ are the eigenvalues of H*WH and the power constraint on W requires $\Sigma_i w_i \leqq P_t$.

B. Capacity of a Volumetric Antenna

Here it is shown that a set of unpolarized uniformly distributed plane waves impinging on a sphere containing antenna elements can be represented by a Rayleigh channel in the spherical modes.

First consider the channel from the transmitted signal x to the received spherical vector modes. Received electric fields are a result of $N_c$ independently distributed plane wave components. In this case, the received electric field is $$E_r(r) = k\sqrt{2\eta} \sum_{\theta} a_{r,\theta} v_\theta(k(r - r_r)), \text{ for } |r - r_r| \geq \varepsilon \tag{10}$$

$$= \sum_{n=1}^{N_c} c_n E_n e^{-jk\hat{k}_n \cdot (r - r_r)}, \text{ for } |r - r_r| \geq \varepsilon \tag{11}$$

where $c_n$ represents the complex signal amplitudes and $E_n$ the random field strengths at point $r_r$ and direction $\hat{k}_n$. The time representation of a wave $e^{j\omega t}$ is used. It is further assumed that for each fixed direction $\hat{k}_n$, the field $E_n$ has zero-mean complex Gaussian components with the variance $E_0^2$, i.e., $E_n = E_0(\phi_1\hat{u}_1 + \phi_2\hat{u}_2)$, where $\hat{u}_n$ are two orthogonal unit vectors that are perpendicular to $\hat{k}_n$ and $\phi_i$ and have variance 1. This assumption causes the polarization of $E_n$ to be uniformly distributed over the Poincare sphere, which means $E_n$ is unpolarized with Stokes parameter $E_o^2 = E[|E_n|^2]$ (see Appendix). The average power flux is normalized to the value $E_0^2/(2\eta)$. Rich scattering is required for these assumptions to be valid.

The received expansion coefficient for mode θ is a function of all $N_c$ incident waves. For uniformly incident waves, these expansion coefficients are given by the expression:

$$a_{r,\theta} = \sum_{n=1}^{N_c} r_\theta c_n \tag{12}$$

$$= \frac{1}{\sqrt{2\eta}\, k} \sum_{n=1}^{N_c} 2\pi j^{1-\tau-l} A_\theta^*(\hat{k}_n) \cdot E_n c_n \tag{13}$$

where $A_\theta^*(\hat{k}_n) \cdot E_n$ is the amplitude for mode θ in the direction of $\hat{k}_n$. By observation, the entries of R are then:

$$r_{\theta_n} = \frac{2\pi}{\sqrt{2\eta}\, k} j^{1-\tau-1} A_\theta^*(\hat{k}_n) \cdot E_n \tag{14}$$

Uniformly distributed directions, $\hat{k}_n$, satisfy:

$$E[r_{\theta' n'} r_{\theta_n}^*] = \frac{\pi E_0^2}{2\eta k^2} \delta_{\theta'\theta} \delta_{n'n} \tag{15}$$

such that E[RR*] is diagonal.

In order to calculate spectral efficiency, the SNR must be normalized with respect to the total power, $P_t$, of the $N_c$ incident waves impinging on a sphere. Normalized expansion coefficients are applied such that the total radiated power is $P_t = \Sigma_\theta |\alpha_{t,\theta}|^2$. It is also assumed that amplitude decay is proportional to the propagation distance so that $E_0/k$ is a constant. As a result, the expression $$\frac{P_t}{N_c} = \frac{\pi E_0^2}{2\eta k^2} \tag{16}$$

can be used as the SNR normalization with respect to the power flux of an electromagnetic wave with wavelength λ through a cross section of a sphere with radius $\in = k^{-1} \equiv \lambda/2\pi$. Multivariate Gaussian distributions satisfy (15), and therefore R can be modeled as the semi-infinite random matrix:

$$R = \sqrt{\frac{P_t}{N_c}}\, Q \tag{17}$$

where Q has identical, independently distributed (i.i.d.) unit-variance complex Gaussian entries and $N_c$ is the number of incident waves.

The transmit side involves the mapping from d to $N_c$ incident waves through the matrix S, i.e. $c = TH_tSd$. Therefore, the matrix $R_t = TH_tH_t^*T^*$ is interpreted as the transmitter contribution to the overall channel correlation matrix and one can write $c = R_t^{1/2}Sd$. Clearly, if the channel is known at the transmitter, setting $S = R_t^{-1/2}$ under the constraint $trSS^* \leqq P_t$ gives a water-filling solution equivalent to transmit beam-forming.

Applying the SVD again to the transmit correlation matrix, i.e., $TH_t = U_t\Lambda_tV_t^*$ allows $\tilde{H} = U_r^*HV_t$ to be treated as an equivalent channel, the capacity formulas shown previously can be used to write:

$$C_{\max} = E_w \max \log\det\left(I + \frac{P_t}{N_t N_c N_0} \Lambda_r \underbrace{\tilde{Q}\Lambda_t W \Lambda_t^* \tilde{Q}^*}_{R_{cc}} \Lambda_r^*\right) \tag{18}$$

$$= \sum_i E_{\lambda_i} \max_w \log\left(1 + \frac{1}{N_0} w_i \lambda_i\right) \tag{19}$$

$$\leq \sum_i E_{\sigma_i} \log\left(1 + \frac{P_t}{N_t N_0} \sigma_i^2\right) \tag{20}$$

where the last inequality is a result of the concavity of log det, such that $$R_{cc}^{(opt)} = \Lambda_t W \Lambda_t^* = N_c I \tag{21}$$

Therefore the equivalent channel decomposition shows that if the channel is known at the transmitter then an optimal transmission strategy is $S = U_t\Lambda_t^{-1}$ subject to the power constraint $trSS^* \leqq P_t$. The eigenvalues $\{w_i\lambda_i\}$ are defined by the entire channel HWH*. For the case of Rayleigh fading, the $\sigma_i^2$'s are eigenvalues of a Wishart matrix filtered by the receive antenna array response $\Lambda_r$. At the sphere boundary, the total power translated from c to y is $trE[H_rH_r^*] = trE[R_r]$. Furthermore, $P_c = trE[cc^*]$ and therefore:

$$P_t = trE[H_r cc^* H_r^*] = trR_r P_c \tag{22}$$

The diagonal entries of $\Lambda_r^2$ are by observation given as:

$$\lambda_i^2 = 1 - |\Gamma_i|^2 \tag{23}$$

$$= \left|1 - e^{-\frac{2\pi}{Q_i B}\left(1-\frac{B^2}{4}\right)}\right| \tag{24}$$

where $Q_i$ is the Q-factor of port i. Since the diagonal entries of $\Lambda_r$ are the amplitudes $\sqrt{1-|\Gamma_i|^2}$ and $\tilde{Q}$ consists of zero-mean Gaussian entries, the eigenvalue PDF is determined by the Marcenko-Pastur Law with SNR for each mode determined by the reflection coefficients. The spectral efficiency for this channel model yields the Rayleigh fading channel capacity, provided the SNR value $E_b/N_0$ is computed using the correct normalization with respect to the total power of the electromagnetic wave impinging on a sphere of radius ∈. Normalization by defining the total power per channel use, $P_t$, as the power of $RN_t$ total bits is required. Given an energy per bit of $E_b$, the result is:

$$\frac{P_t}{N_t N_0} = \frac{RN_t E_b}{N_t N_0} = \frac{RE_b}{N_0} = \frac{\pi E_0^2}{2\eta k^2 N_0} \tag{25}$$

This normalization and the singular value representation from (24) leads to the following capacity expression as a function of the antenna quality factor:

$$C_Q = \sum_{i=1}^{N_r} E_{\sigma_i} \max_{w_i} \log_2\left(1 + \frac{P_t}{N_t N_0}\left|1 - e^{-\frac{2\pi}{Q_i B}\left(1-\frac{B^2}{4}\right)}\right| w_i \lambda_i\right) \tag{26}$$

$$\leq \sum_{i=1}^{N_r} E_{\sigma_i} \log_2\left(1 + \frac{P_t}{N_t N_0}\left|1 - e^{-\frac{2\pi}{Q_i B}\left(1-\frac{B^2}{4}\right)}\right| \sigma_i^2\right) \tag{27}$$

where as before, the last inequality is a result of the fact that water-filling requires a W such that $R_{cc}=N_c I$. For the case of Rayleigh fading, the $\sigma_i^2$'s are distributed according to the Marcenko-Pastur Law. Note that only the lower order modes (l=1) contribute to the capacity when the volume is small (k∈<0.5). Consequently, only one spatial channel per antenna, up to a maximum of six (3 electric, 3 magnetic) contribute to the capacity for small volume antennas. On the other hand, the transition from 0 to 1 happens very quickly, indicating volumetric antennas with spacing as small as a few tenths of a wavelength can achieve nearly uncorrelated performance.

C. Capacity of Randomly Oriented Dipoles

Figure 3:
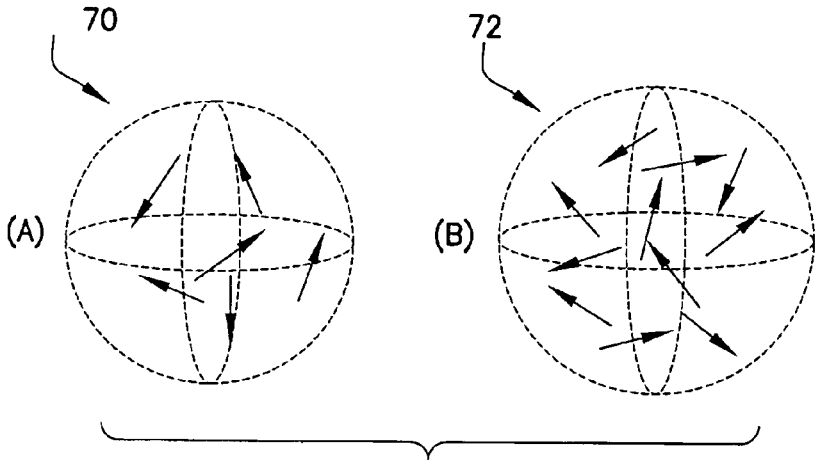
FIG. 3A illustrates an exemplary utilization of randomly-oriented dipole antennas in a sphere.
FIG. 3B illustrates an exemplary utilization of randomly-oriented dipole antennas in a sphere.

FIG. 3 illustrates one exemplary application of the analytical results described thus far by utilizing randomly-oriented dipole antennas in a sphere. These randomly-oriented dipole antennas have the same ergodic capacity as regularly shaped antennas when averaged over all possible channel realizations. That is, the 6 randomly-oriented dipole antennas in the first sphere 70 (FIG. 3A) have the same ergodic capacity as the regularly shaped MIMO tetrahedron. Similarly, the 12 randomly-oriented dipole antennas in the second sphere 72 (FIG. 3B) have the same ergodic capacity as the regularly shaped MIMO cube.

Analytical and empirical results further show volumes with a large enough radius such that the average spacing between randomly oriented dipoles is a few tenths to ½ of a wavelength can achieve uncorrelated capacities. As a result, many of the problems associated with specifying, fabricating, and testing regular shapes can be avoided by randomly orienting multiple electric dipole antennas in a sphere and characterizing the performance based on the radiation efficiency (Q-factor) of each dipole in the array.

V. FRACTAL PROPERTIES

Euclidean geometry provides up to 3 orthogonal dimensions in space. Objects in Euclidean space are defined with an integer number of orthogonal dimensions, e.g., a line has 1 dimension, a square has 2 dimensions, and a sphere has 3 dimensions. Corresponding monopole, dipole and omni-directional radiation patterns are generated at wavelengths determined by the length, area, or volume of an antenna.

If a larger object consists of a number of smaller objects of the same shape, then the object is said to be self-similar. If the object is also symmetric about a point in M dimensional Euclidean space, then the object is a fractal.

Fractal shapes have dimensionalities that can be expressed as ratios that are determined by the density of the fractal. Density in this context is related to the number of component fractals in a large fractal, and is quantified by the fractal or Hausdorff dimensionality, D, in terms of the occupied volume of a component fractal, p, and the occupied volume, P, of a fractal composed of N shapes of size p. Fractional dimensionality is given by:

$$D = \frac{\log N}{\log \frac{P}{p}} \tag{28}$$

Note that D≦M for fractals drawn in M Euclidean dimensions. One can solve (28) for N:

$$N = \left(\frac{P}{p}\right)^D, \; D \leq M \tag{29}$$

which shows the number of possible fractal shapes in a constant volume increases without bound. A "dense" fractal has $N=(P/p)^D >> 1$ and is shown to essentially have a dipole response whenever the conductor length between feeds is less than the wavelength λ.

A. Fractal as a Dipole

1) Dipole Response: The voltage response of a dipole is dominated by the electric field of a carrier wave, $V_{max}=\sqrt{2}\alpha E$. The radiation resistance, $R_{rad}$, is a simple measure of broadcast efficiency that relates time-averaged power to peak drive current:

$$P = \frac{1}{2} I_0^2 R_{rad} \tag{30}$$

Note that the Q-factor discussed previously is inversely proportional to radiation resistance. A low value for $R_{rad}$ (high value for Q) means a majority of power is being absorbed by the antenna, causing the temperature to rise and performance to degrade. The radiation resistance of a small linear dipole with length a much less than the wavelength λ has been computed, for example, as:

$$R_{rad} = \left(\frac{a}{\lambda}\right)^2 197\Omega \tag{31}$$

2) Fractal Response: Current density that can be differentiated to find charge density is required in order to show a fractal behaves essentially as an electric dipole. In one example, a Fourier series model for the current density is used:

$$I(l, t) = -\oint_l \frac{j}{\omega}\rho(l, t)dl \tag{32}$$

$$= I_0 \frac{\sum_n A_n \sin\left(\frac{nkL}{2}\left(1 - \frac{2|l|}{L}\right)\right)}{\sum_n A_n \sin\left(\frac{nkL}{2}\right)} e^{-j\omega t} \tag{33}$$

One can take advantage of fractal symmetry when applying (33). Without loss of generality, assume the symmetry is oriented along the y-axis, which causes the x-component of the charge density to vanish and the y-component to be given by:

$$\rho_y(t) = \frac{2jI_0}{c\sum_n A_n \sin\left(\frac{nkL}{2}\right)} e^{-j\omega t} \cdot \int_0^{\frac{a}{2}} y \sum_n nA_n \cos\left(\frac{nkL}{2} - nkl(y)\right) dy \tag{34}$$

The charge is positive in one direction and negative in the opposite direction along the axis of symmetry.

For dense patterns, the function l(y) may be considered random and uniformly distributed between 0 and L/2, which allows the cosine term to be approximated by the average value. Also at a height y, there are multiple values due to the N copies of the fractal, so one has L/a copies of the average value. With these considerations in mind, an approximate charge density is given by:

$$\rho_y(t) \approx \frac{jI_0 a}{2\omega} e^{j\omega t} \tag{35}$$

In Gaussian units, the time-averaged power computed from the charge density is:

$$P = \frac{|\ddot{\rho}_y(t)|^2}{3c^3} = \frac{I_0^2}{2}\frac{2\pi^2}{3c}\frac{a^2}{\lambda^2} \equiv \frac{1}{2} I_0^2 R_{rad} \tag{36}$$

Noting 1/c=30Ω, the radiation resistance for a dense fractal antenna with L≈λ is:

$$R_{rad} = \left(\frac{a}{\lambda}\right)^2 197\Omega \tag{37}$$

which is the same radiation resistance of a small linear dipole. A dense fractal has $N=(P/p)^D >> 1$.

It is well-known that a simple N-dimensional fractal shape can be derived from the number of 1's (or 0's) in a binary representation of N−1 dimensions. Such a representation makes this binary fractal shape uniquely scalable for use as the dipoles in FIG. 3, for example.

Element locations, and therefore the range of wavelengths for which the fractal shape can be used as an electric dipole, are generated by creating a difference equation along the horizontal and vertical axes of symmetry. Assuming a coordinate transformation such that these axes are along horizontal and vertical axes, the difference equation formed from the (x, y) coordinates of the fractal can be expressed as:

$$\Delta f_k(x_k, y_k) = (x_k - x_{k-1}, y_j - y_{k-1}) \tag{38}$$

where $f_k(x_k, y_k)$ is a point on a plane corresponding to the sum of the number of 1's in the binary representation of $(x_k, y_k)$. Each point where either the x or y component of (38) is equal to zero indicates the boundary between self-similar objects, which corresponds to the "edge" of the fractal shape.

Figure 4:
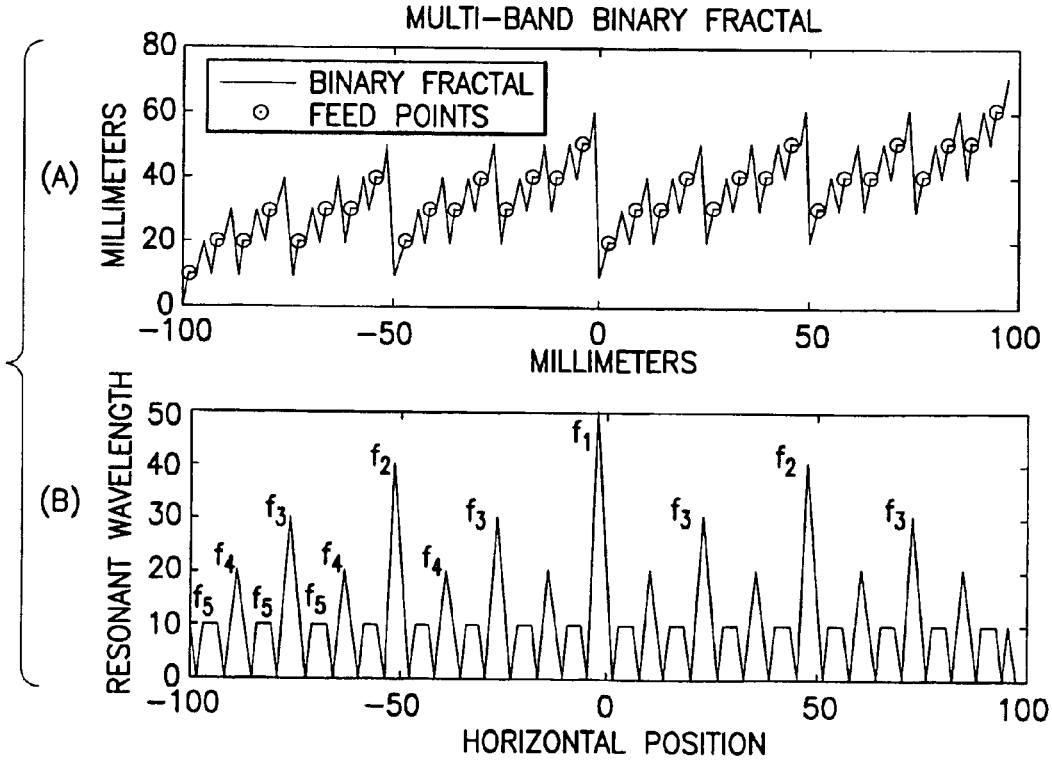
FIG. 4A shows an exemplary multi-band binary fractal shape for an antenna element.
FIG. 4B depicts a resonant wavelength plot for a base fractal length of 10 mm corresponding to the exemplary antenna element of FIG. 8A.

An exemplary fractal shape and corresponding plot of (38) for a base fractal length of 10 mm is shown in FIG. 4. That is, FIG. 4A shows a plot of an exemplary multi-band binary fractal antenna element in accordance with (38). The exemplary antenna element of FIG. 4A has rotational symmetry about its midpoint. In addition, the shape of the antenna has a same basic appearance independent of scale. That is, the shape of the antenna appears similar at multiple levels of magnification. The exemplary antenna element of FIG. 4A can be used, in multiples, to form MIMO fractal volume antennas and systems in accordance with the exemplary embodiments of the invention as further described herein.

FIG. 4B depicts a corresponding plot of resonant wavelength for the exemplary antenna element of FIG. 4A. The plot illustrates a number of frequency bands (the peaks in the plot of FIG. 4B) at which dipoles can be produced and received by the fractal antenna element of FIG. 4A. There is one band for a first frequency ($f_1^{(n)}$, n=1). There are two bands for a second frequency ($f_2^{(n)}$, n=1, 2). There are four bands for a third frequency ($f_3^{(n)}$, 1≦n≦4, where n is an integer), eight bands for a fourth frequency ($f_4^{(n)}$, 1≦n≦8, where n is an integer) and sixteen bands for a fifth frequency ($f_5^{(n)}$, 1≦n≦16, where n is an integer). As is apparent, the higher the frequency, the more potential feed points that exist.

The exemplary antenna element (FIG. 4A) and corresponding plot (FIG. 4B) are one example of a suitable antenna element that may be utilized in conjunction with the exemplary embodiments of the invention. In other exemplary embodiments, different antenna elements (e.g., having a different shape, a different number of resonant wavelengths, a different configuration) may be utilized.

Figure 5:
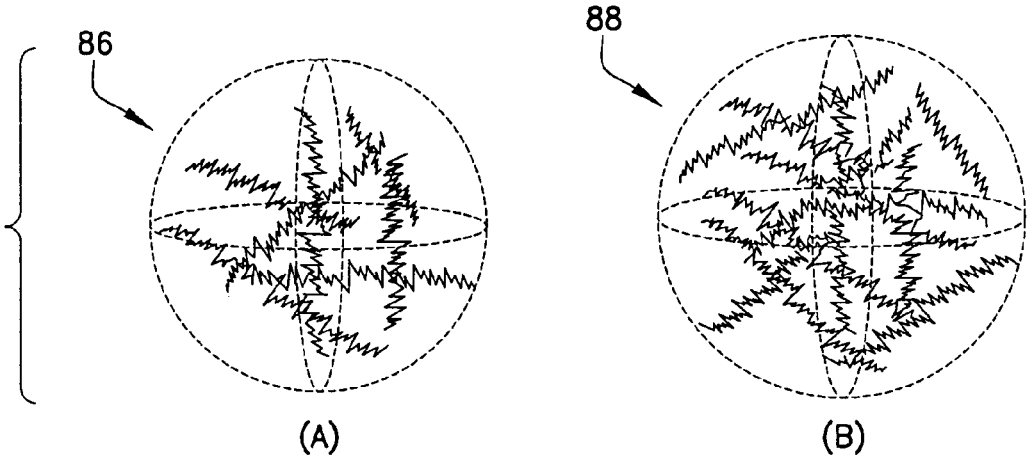
FIG. 5A depicts an exemplary randomly-oriented configuration.
FIG. 5B depicts another exemplary randomly-oriented configuration.

FIG. 5 shows an example for using the binary fractal dipole antenna of FIG. 4 to create multi-band volumetric antennas. FIG. 5 shows two exemplary randomly-oriented configurations, a six-element configuration 86 (FIG. 5A) and a twelve-element configuration 88 (FIG. 5B), that are equivalent in capacity to a tetrahedron antenna and a cube antenna, respectively. The configurations depicted in FIG. 5 have the same number of possible feeds and the same ergodic capacities as the tetrahedron and cube configurations, however they occupy less space due to the spherical volume constraint.

Other exemplary embodiments of the invention may utilize, be based on or correspond to different shapes (e.g., regular shapes) and/or different arrangements of antenna elements. Furthermore, in other exemplary embodiments the randomly-oriented configurations (such as the ones shown in FIGS. 5A and 5B) may not comprise fractal elements.

Exemplary embodiments of the invention may be implemented using any suitable technique, fabrication process, arrangement and materials. For example, the dipoles can be printed on a curved substrate. As another non-limiting example, the dipoles can be immersed in a dielectric or multi-dielectric material. As a further non-limiting example, the antenna elements may be produced using a printing method (e.g., printed antenna elements). One of ordinary skill in the art will appreciate the various options and techniques available.

In one non-limiting, exemplary embodiment of the invention, an antenna system is provided. The antenna system may be capable of transmitting high-dimensional MIMO constellations such that the antenna system is compact and can serve multiple frequency bands simultaneously. In further exemplary embodiments, multiple MIMO fractal volume antennas are cascaded to provide a required amount of wave vector coefficients providing a given amount of beam-forming capability. In further exemplary embodiments, a fractal based on the number of 1's and 0's in a binary representation of the integer field is used to generate the fractal antenna.

VI. ADDITIONAL CONSIDERATIONS

Conventional antenna networks are "tuned" in order to work with a transmitter and receiver. The analog circuits are adjusted until the maximum coupling efficiency is found. Essentially, the shape of the antenna and other properties are adjusted until good performance is achieved.

One aspect of the exemplary embodiments of the invention is to move these "tuning" methods into the digital realm. Improvement over conventional methods is achieved by providing the digital signal processing (DSP) engines with multiple randomly oriented antenna responses. The data communications carrier signal is adjusted based on the statistical properties of the combined transmitter and receiver signals. Matrix S (adaptive) adjusts to matrices R (random with channel response determined at time of manufacture) such that the desired capacity and properties are achieved. As a non-limiting example, the DSP may utilize a conventional linear beam-forming method and techniques (e.g., linear estimation and adaptation of the matrices R and S). The pre-processed response will be chaotic and will have random performance for systems that do not have the digital iterative MIMO network. The post-processed response can achieve the same capacity as a conventional "tuned" antenna.

As one non-limiting example, manufacturing of the randomly oriented dipole antennas may be achieved as follows. A number of dipole antennas (wires) are embedded in a substrate infused with dielectric materials that respond to many frequencies (e.g., each dielectric material corresponds to a given frequency). Each section of the fractal dipole has a different alloy that reacts to the uniformly distributed dielectric materials. An un-interrupted electric conductor bounds the fractal elements so that each portion of the dipole can be connected to a common feed.

Certain random configurations may be found to have low performance for any channel (e.g., all elements are oriented basically in a same direction). Configurations will have to be tested and accepted or discarded based on the test results. As a non-limiting example, during production there will be an element of randomness in the formation of the antenna elements. The production process may include a screening step to measure the capacity of a specific configuration and either use it or discard it depending on the results.

VII. CONCLUSION

Total capacity of an antenna array is a sum of the active dipoles at each of the indicated frequency bands, as discussed in the previous sections. Beam-forming requires a (digitally) weighted sum of the antenna element responses. A volumetric antenna comprised of electric dipoles generated with fractal shapes (e.g., fractals generated in two dimensions, i.e., that have a fractal dimension between 1 and 2) creates a polarization agnostic antenna with multiple frequency bands in which simultaneous beam-formed and/or space-time coded signals can be processed. Such antennas provide digital signal processing architectures with a unique capability to simultaneously process polarization, frequency, and spatial channels in order to increase capacity and robustness.

VIII. FURTHER EXEMPLARY EMBODIMENTS

Below are further descriptions of various non-limiting, exemplary embodiments of the invention. The below-described exemplary embodiments are numbered separately for clarity purposes. This numbering should not be construed as entirely separating the various exemplary embodiments since aspects of one or more exemplary embodiments may be practiced in conjunction with one or more other aspects or exemplary embodiments.

(1) In one non-limiting, exemplary embodiment, an antenna arrangement comprising: a substrate; and a plurality of dipole antenna elements disposed on (or in) the substrate, wherein the plurality of dipole antenna elements are randomly-oriented with respect to each other.

The antenna arrangement as above, wherein the plurality of dipole antenna elements are disposed on the substrate within a substantially spherical region. The antenna arrangement as in any above, wherein a size of the substantially spherical region is such that an average spacing between the randomly-oriented dipole antenna elements is in a range from around one-tenth of a wavelength to around half of a wavelength. The antenna arrangement as in any above, wherein the plurality of dipole antenna elements comprises center-fed electric dipoles and wherein the substantially spherical region has a radius of at least half of a wavelength. The antenna arrangement as in any above, wherein at least a portion of the substrate having at least one dipole antenna element has a radius of curvature.

The antenna arrangement as in any above, wherein the plurality of dipole antenna elements comprises at least six dipoles that are all electrically fed and do not need to be magnetically fed in order to generate and detect an arbitrary polarization. The antenna arrangement as in any above, wherein a performance of the volumetric antenna is characterized based on a radiation efficiency of each dipole antenna element. The antenna arrangement as in any above, wherein the number of dipole antenna elements corresponds to a number of edges in a regular three dimensional shape. The antenna arrangement as in any above, wherein at least one dipole antenna element comprises a fractal shape.

The antenna arrangement as in any above, wherein each dipole antenna element comprises a fractal shape. The antenna arrangement as in any above, wherein the fractal shape comprises a binary fractal shape. The antenna arrangement as in any above, wherein the binary fractal shape is based on a difference equation formed from (x, y) coordinates expressed as $$\Delta f_k(x_k,y_k)=(x_k-x_{k-1},y_k-y_{k-1}),$$

where $f_k(x_k, y_k)$ is a point on a plane corresponding to a sum of a number of 1's in a binary representation of $(x_k, y_k)$. The antenna arrangement as in any above, further comprising one or more additional aspects of the exemplary embodiments of the invention as described herein.

(2) In another non-limiting, exemplary embodiment, a communication system comprising: at least one antenna arrangement comprising a substrate and a plurality of dipole antenna elements disposed on (or in) the substrate, wherein the plurality of dipole antenna elements are randomly-oriented with respect to each other; at least one processor coupled to the at least one antenna arrangement, wherein the at least one processor is configured to perform at least one of generating a first signal to be transmitted via the at least one antenna arrangement and processing at least one second signal received via the at least one antenna arrangement.

The communication system as above, wherein the at least one antenna arrangement comprises a plurality of antenna arrangements configured to implement at least one of Beamforming and multiple-input multiple-output (MIMO) communication. The communication system as in any above, further comprising one or more additional aspects of the exemplary embodiments of the invention as described herein.

Figure 6:
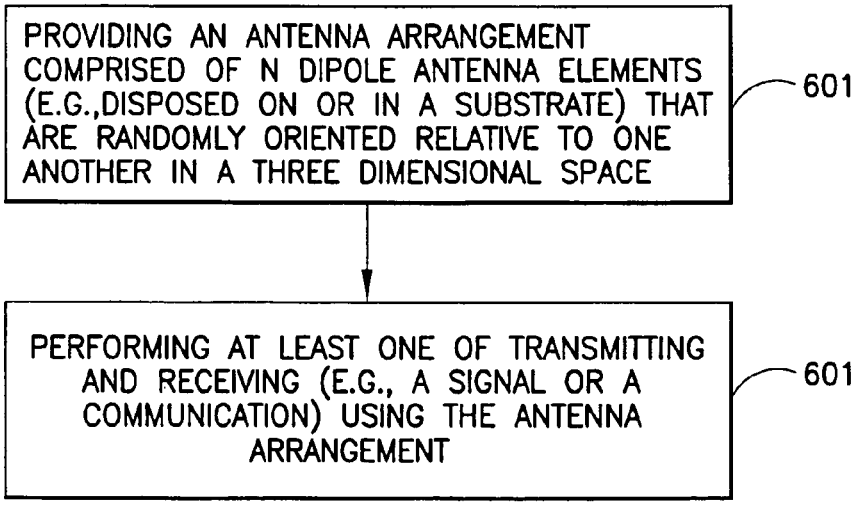
FIG. 6 depicts a flowchart illustrating one non-limiting example of a method for practicing the exemplary embodiments of this invention.

(3) In another non-limiting, exemplary embodiment, and as illustrated in FIG. 6, a method comprising: providing an antenna arrangement comprised of n dipole antenna elements (e.g., disposed on or in a substrate) that are randomly oriented relative to one another in a three dimensional space (601); and performing at least one of transmitting and receiving (e.g., a signal or a communication) using the antenna arrangement (602).

The method as above, wherein the antenna arrangement has a substantially similar performance as a polyhedron antenna arrangement having n edges. The method as in any above, further comprising one or more additional aspects of the exemplary embodiments of the invention as described herein.

(4) In another non-limiting, exemplary embodiment, a method comprising: receiving at least one signal via at least one antenna arrangement comprised of a substrate and a plurality of dipole antenna elements disposed on (or in) the substrate, wherein the plurality of dipole antenna elements are randomly-oriented with respect to each other; and processing the at least one received signal by selecting a dipole antenna element (of the plurality of dipole antenna elements) with (having) a largest signal-to-noise ratio (e.g., in order to further process, by a receiver, the signal received by the selected dipole antenna element).

The method as above, further comprising one or more additional aspects of the exemplary embodiments of the invention as described herein.

(5) In another non-limiting, exemplary embodiment, a method comprising: providing n dipole antenna elements (e.g., disposed in a substrate); randomly orienting the n dipole antenna elements (e.g., relative to one another) in a three dimensional space to form an antenna arrangement comprised of the n dipole antenna elements; and performing at least one of transmitting and receiving (e.g., a signal or a communication) using the antenna arrangement.

The method as above, further comprising one or more additional aspects of the exemplary embodiments of the invention as described herein.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention.

Any use of the terms "connected," "coupled" or variants thereof should be interpreted to indicate any such connection or coupling, direct or indirect, between the identified elements. As a non-limiting example, one or more intermediate elements may be present between the "coupled" elements. The connection or coupling between the identified elements may be, as non-limiting examples, physical, electrical, magnetic, logical or any suitable combination thereof in accordance with the described exemplary embodiments. As non-limiting examples, the connection or coupling may comprise one or more printed electrical connections, wires, cables, mediums or any suitable combination thereof.

Although exemplary embodiments of the invention have been described above with reference to the exemplary embodiments shown in the drawings, it should be understood that the invention can be embodied in many alternate forms of embodiments. In addition, any suitable size, shape or type of elements or materials could be used. Although, described above with reference to a spherical region, other two-dimensional or three-dimensional shapes may be utilized.

Furthermore, some of the features of the preferred embodiments of this invention could be used to advantage without the corresponding use of other features. As such, the foregoing description should be considered as merely illustrative of the principles of the invention, and not in limitation thereof.

What is claimed is:

1. An antenna arrangement comprising:

a substrate comprising a three-dimensional space; and a plurality of dipole antenna elements disposed inside the three-dimensional space of the substrate, wherein the plurality of dipole antenna elements are randomly-oriented with respect to each other inside the three-dimensional space, wherein each of the plurality of dipole antenna elements has a two-dimensional fractal shape, and wherein the dipole antenna elements form a three-dimensional volumetric antenna in the three-dimensional space for transmitting or receiving radio frequency signals.

2. The antenna arrangement of claim 1, wherein the three-dimensional space of the substrate is substantially spherical.

3. The antenna arrangement of claim 2, wherein the plurality of dipole antenna elements are disposed within the substantially spherical three-dimensional space of the substrate such that an average spacing between the randomly-oriented dipole antenna elements is in a range from around one-tenth of a wavelength to around half of a wavelength.

4. The antenna arrangement of claim 2, wherein the plurality of dipole antenna elements comprises center-fed electric dipoles and wherein the substantially spherical three-dimensional space of the substrate has a radius of at least half of a wavelength.

5. The antenna arrangement of claim 1, wherein at least a portion of the three-dimensional space of the substrate has a radius of curvature.

6. The antenna arrangement of claim 1, wherein the plurality of dipole antenna elements comprises at least six dipoles that are electrically fed, wherein the at least six dipoles are magnetically fed.

7. The antenna arrangement of claim 1, wherein a performance of the antenna arrangement is characterized based on a radiation efficiency of each dipole antenna element.

8. The antenna arrangement of claim 1, wherein a number of dipole antenna elements in the plurality of dipole antenna elements corresponds to a number of edges in a regular three dimensional shape.

9. The antenna arrangement of claim 1, wherein the fractal shape comprises a binary fractal shape.

10. The antenna arrangement of claim 1, wherein the plurality of dipole antenna elements are randomly-oriented with respect to each other across all three dimensions of the three-dimensional space.

11. The antenna arrangement of claim 1, wherein the substrate comprises a plurality of different dielectric materials each of which responds to a different frequency.

12. The antenna arrangement of claim 1, wherein each of the dipole antenna elements comprises:

sections each of which comprises a different material; and an uninterrupted electric conductor bounding the sections.

13. A communication system comprising:

at least one three-dimensional volumetric antenna comprising a substrate and a plurality of dipole antenna elements disposed inside a three-dimensional space of the substrate, wherein the plurality of dipole antenna elements are randomly-oriented with respect to each other inside the three-dimensional space, wherein each of the plurality of dipole antenna elements has a two-dimensional fractal shape, and wherein the plurality of dipole antenna elements form the three-dimensional volumetric antenna in the three-dimensional space;

at least one processor coupled to the dipole antenna elements of the three-dimensional volumetric antenna, wherein the at least one processor is configured to perform at least one of generating a first signal to be transmitted via the three-dimensional volumetric antenna and processing at least one second signal received via the three-dimensional volumetric antenna.

14. The communication system of claim 13, wherein the three-dimensional space is a substantially spherical region.

15. The communication system of claim 13, wherein the plurality of dipole antenna elements comprises at least six dipoles that are electrically fed, wherein the at least six dipoles are not magnetically fed.

16. The communication system of claim 13, wherein a number of dipole antenna elements in the plurality of dipole antenna elements corresponds to a number of edges in a regular three dimensional shape.

17. The communication system of claim 13, wherein the fractal shape comprises a binary fractal shape.

18. The communication system of claim 13, wherein the at least one three-dimensional volumetric antenna is one of a plurality of antenna arrangements configured to implement at least one of Beamforming and multiple-input multiple-output (MIMO) communication.

19. The communication system of claim 13, wherein the plurality of dipole antenna elements are randomly-oriented with respect to each other across all three dimensions of the three-dimensional space.

20. The communication system of claim 13, wherein the substrate comprises a plurality of different dielectric materials each of which responds to a different frequency.

21. The communication system of claim 13, wherein each of the dipole antenna elements comprises:

sections each of which comprises a different material; and an uninterrupted electric conductor bounding the sections.

22. A method comprising:

providing a three-dimensional volumetric antenna comprised of n dipole antenna elements that are randomly oriented relative to one another inside a three dimensional space of a substrate, wherein each of the n dipole antenna elements has a two-dimensional fractal shape; and performing at least one of transmitting and receiving a signal using the three-dimensional volumetric antenna.

23. The method of claim 22, wherein the antenna arrangement has a substantially similar performance as a polyhedron antenna arrangement having n edges.

* * * * *